US005855124A

United States Patent [19]

Donaghy et al.

[11] Patent Number: 5,855,124

[45] Date of Patent: Jan. 5, 1999

[54] MOLDABLE WARP KNITTED FABRIC AND METHOD OF FORMING A SEAMLESS MOLDED FABRIC PORTION THEREFROM

[75] Inventors: James G. Donaghy, Emerson, N.J.; Ivan M. Azuero, Angier, N.C.

[73] Assignee: Guilford Mills, Inc., Greensboro, N.C.

[21] Appl. No.: 885,295

[22] Filed: Jun. 26, 1997

[51] Int. Cl.[6] ..... D04B 7/16

[52] U.S. Cl. ..... 66/195; 66/202; 450/40; 442/312

[58] Field of Search ..... 66/169 R, 170, 66/171, 175, 176, 190, 192, 195, 196, 202; 442/304, 306, 308, 312, 318; 450/39, 40

[56] References Cited

U.S. PATENT DOCUMENTS

| | | | |
|---|---|---|---|
| 2,191,545 | 2/1940 | Schneider . | |
| 2,460,674 | 2/1949 | Bihaly . | |
| 2,616,084 | 11/1952 | Shearer . | |
| 2,617,102 | 11/1952 | MacHenry . | |
| 2,760,198 | 8/1956 | Poole et al. . | |
| 2,867,889 | 1/1959 | Thompson, Jr. . | |
| 2,893,396 | 7/1959 | Thomson, Jr. . | |
| 3,026,227 | 3/1962 | Flagg et al. . | |
| 3,070,070 | 12/1962 | Trevor . | |
| 3,187,754 | 6/1965 | King . | |
| 3,434,478 | 3/1969 | Liebowitz et al. . | |
| 3,799,174 | 3/1974 | Howard . | |
| 3,981,310 | 9/1976 | Donaghy . | |
| 4,148,322 | 4/1979 | Jacaruso et al. . | |
| 4,557,267 | 12/1985 | Cole . | |
| 4,601,940 | 7/1986 | Fischer | 66/202 |
| 4,649,014 | 3/1987 | Tochikawa . | |
| 4,667,490 | 5/1987 | Patel | 66/202 |
| 5,362,546 | 11/1994 | Boulanger . | |
| 5,543,094 | 8/1996 | Hara et al. . | |
| 5,669,247 | 9/1997 | McCartney et al. | 66/195 |

*Primary Examiner*—Michael A. Neas
*Assistant Examiner*—Larry D. Worrell, Jr.
*Attorney, Agent, or Firm*—Kennedy Covington Lobdell & Hickman, LLP

[57] ABSTRACT

A three-bar moldable warp knitted fabric having a satin-like technical back suitable for use in forming seamless molded breast cups for women's brassieres is produced on a Raschel warp knitting machine by knitting satin-effect yarns on the machine's bottom bar in coursewise extended underlaps producing the satin-like technical back of the fabric, knitting high elongation-high shrinkage monofilament POY draw-warped polyester yarns on the machine's middle bar to form a stabilized fabric ground structure, and inlaying elastic yarns with the machine's top bar to impart a compacted stitch density to the fabric when relaxed. When placed over a heated molding surface of a breast cup mold, the ground yarns shrink sufficiently and become heat set to collapse the fabric into a permanent shape conforming to the molding surface, the elastic yarns maintaining sufficient stitch density in the molded fabric to retain a uniform satin-like surface effect at the fabric's technical back.

18 Claims, 2 Drawing Sheets

MOLDABLE WARP KNITTED FABRIC AND METHOD OF FORMING A SEAMLESS MOLDED FABRIC PORTION THEREFROM

BACKGROUND OF THE INVENTION

The present invention relates generally to warp knitted fabrics and the manufacture of apparel from such fabrics. More particularly, the present invention relates to a warp knitted fabric characterized by the ability to be molded and heat set into a permanent shape and to a method for forming a seamless molded fabric portion, e.g., a breast cup for a woman's brassiere, utilizing such fabric.

As is well-known, textile fabrics are manufactured in flat planar sheet form which accordingly must be cut into various shapes to be sewn together in order to fashion garments into appropriate shapes to fit the human anatomy. Such has traditionally been true particularly of specialty garments intended to be close-fitting, such as women's brassieres.

While cut-and-sewn brassieres have proven to perform quite satisfactorily in retaining their shape over extended numbers of wearings and washings, the sewn seams in such brassieres, particularly in the breast cups, are nevertheless undesirable in that the seams tend to be visible through some clothing and also detract from the comfort of the brassieres.

Accordingly, the textile garment industry has sought for some time to produce women's brassieres with seamless breast cups without sacrificing the desirable shape-retention characteristics of traditional cut-and-sewn brassieres. To do so, most development effort in the field has been directed toward creating textile fabrics which can be permanently molded through heat setting into various breast cup sizes and shapes.

U.S. Pat. No. 3,981,310 describes the historical progression of such moldable fabrics and discloses a warp knitted polyester fabric specifically designed to overcome the deficiencies of prior art molded fabrics. While the fabric described in U.S. Pat. No. 3,981,310 and other similar moldable fabrics have achieved a reasonable degree of commercial success to the point that currently brassieres with seamless breast cups represent approximately 38% of all brassiere sales in the United States, no moldable fabric has yet been developed which will closely simulate the woven satin fabrics which have long been the fabric of choice in cut-and-sewn brassieres.

SUMMARY OF THE INVENTION

It is accordingly an object of the present invention to provide a moldable warp knitted fabric presenting a satin-like surface feel and appearance which can be molded by heat setting so as to be suitable for use in making breast cups for women's brassieres. A further object of the present invention is to provide a novel method of forming a seamless molded brassiere breast cup utilizing such fabric. Other objects and advantages of the present invention will be apparent from the disclosure which follows.

Briefly summarized, the warp knitted fabric of the present invention basically comprises a first set of yarns warp knitted in coursewise extending underlaps at the technical back of the fabric to provide a satin-like surface effect, interknitted with a set of ground yarns warp knitted in a stitch pattern forming a stabilized fabric ground structure. The ground yarns comprise POY polyester yarns having a substantially high denier per filament of at least about 10 denier per filament, a substantially high degree of elongatability of at least about 55% elongation, and a substantially high degree of shrinkability of at least about 9% shrinkage to impart a collapsibility and a setability to the knitted structure of the ground yarns in the presence of heat. Thus, the fabric is characterized by a moldability to collapse and become set into a permanent shape conforming to a three dimensional mold (such as a breast cup mold) when subjected to heat, but without distension of the knit structure of the fabric.

Preferably, the fabric is warp knitted of a three-bar Raschel construction including a set of elastic yarns inlaid with the satin-effect and ground yarns. Optimally, the polyester ground yarns are monofilament yarns partially oriented by draw warping to achieve the desired degrees of elongatability, preferably at least about 60% elongation, and shrinkability, preferably at least about 10% shrinkage. In a preferred embodiment, the satin-effect yarns are warp knitted in a 4-6, 2-0 stitch pattern to produce the coursewise underlaps desired at the technical back of the fabric to provide the satin-like surface effect, while the ground yarns are warp knitted in a 2-0, 2-4 stitch pattern to provide the stabilized fabric ground structure and the elastic yarns are inlaid in a 0-0, 4-4 pattern. The elastic yarns advantageously serve to constrict the fabric when relaxed to impart a compacted stitch density to the fabric to accentuate the satin-like appearance and feel. The satin-effect yarns in the preferred fabric are multi-filament yarns of approximately 20 denier while the monofilament ground yarns are preferably approximately 22 denier. The elastic yarns may be of varying deniers, but preferably are of a sufficient denier to comprise about 10% to 15% of the fabric by weight.

The methodology of the present invention for forming a molded fabric piece, e.g., seamless molded brassiere breast cups, involves initially draw warping a set of high denier-per-filament polyester yarns (preferably monofilament) at a selected draw ratio and under selected temperature conditions to partially orient the yarns while imparting to the yarns the desired degrees of elongatability and shrinkability as described above. The draw warped polyester yarns are then warp knitted into the aforedescribed textile fabric, after which the fabric is placed over a molding surface, e.g., a breast cup mold, and subjected to sufficient heat to shrink and set the partially-oriented polyester ground yarns, causing the fabric to collapse and set into a permanent shape conforming to the molding surface.

DESCRIPTION OF THE PREFERRED EMBODIMENT

Figure 1:
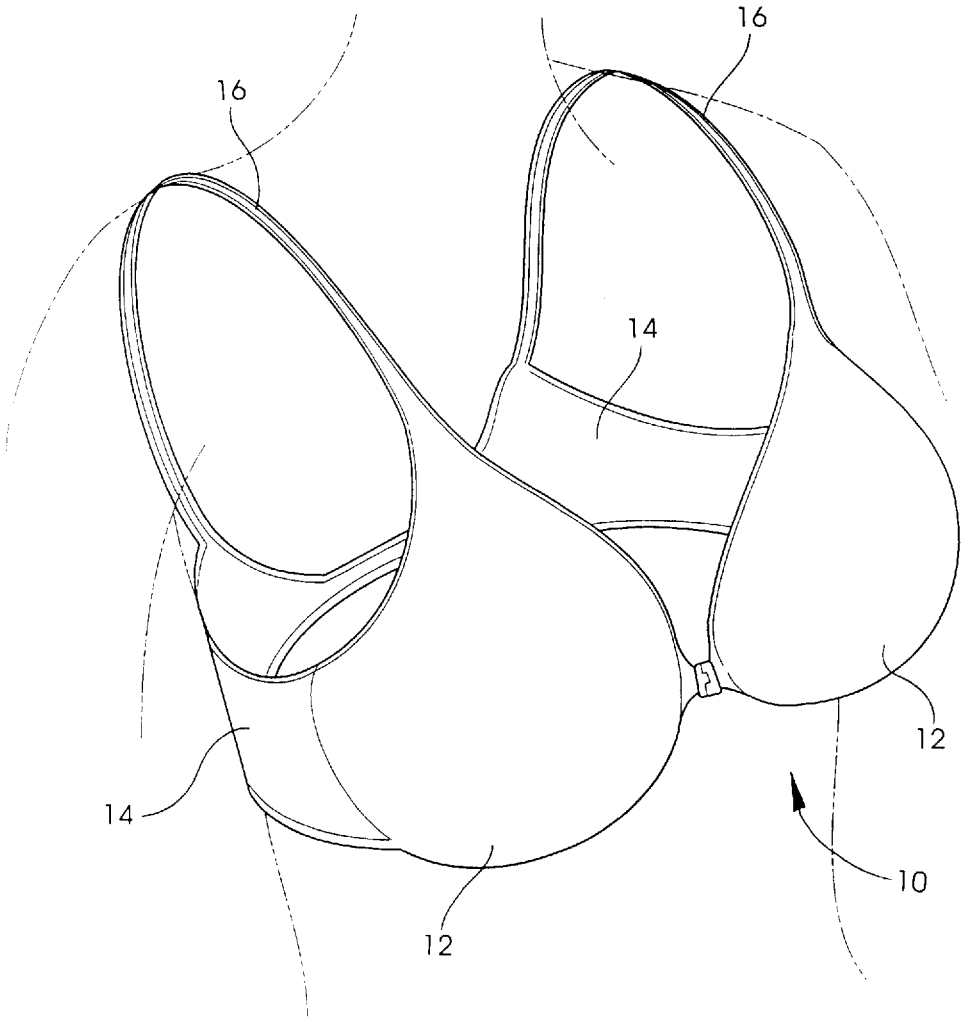
FIG. 1 is a front perspective view of a woman's brassiere having seamless molded breast cups of the type which may be fabricated in accordance with the method of the present invention utilizing the novel warp knitted textile fabric described herein.

Referring now to the accompanying drawings and initially to FIG. 1, a woman's brassiere of the type having seamless molded breast cups formed utilizing the warp knitted fabric and methodology of the present invention is depicted generally at 10. Of course, those persons skilled in the art will recognize that the brassiere 10 is merely representative of one style of brassiere known within the apparel art and that molded cups fashioned from the present warp knitted fabric utilizing the method of the present invention may be equally well incorporated into substantially any other style of brassiere now known or hereafter developed. The brassiere 10 is depicted in FIG. 1 merely by way of example for purposes of providing an enabling disclosure of the present invention and it is accordingly to be understood that the present invention is not limited to brassieres of the configuration and construction of the brassiere 10. Indeed, the characteristics of moldability provided by the present fabric and methodology are contemplated to be applicable to the fabrication of numerous other fabric items and components, whether for use in apparel or other items made from textile fabrics, wherein a molded three-dimensional contour to the fabric item or component is desirable.

As seen in FIG. 1, the brassiere 10 basically comprises a pair of molded seamless breast cups 12 sewn along their respective outer margins into a torso-encircling band, indicated in its totality at 14, and two shoulder straps 16 extending from the upper margin of each breast cup 12 to the rearward extent of the band 14. As already indicated, the basic construction of the brassiere 10 beyond the novel fabric and fabric molding methodology for the breast cups 12 is known and does not form a part of the present invention. Hence, it is not believed necessary to describe in any further detail the cut-and-sewn fabrication and structure of the body encircling band 14 and the shoulder straps 16 of the brassiere 10, inasmuch as such components and alternatives thereto will be readily appreciated by persons skilled in the art.

Fundamentally, as already indicated above, the present invention resides in the novel warp knitted fabric and the novel methodology of forming and molding the fabric into the permanent three-dimensional shape of the breast cups 12. While various embodiments of the warp knitted fabric and the methodology of the present invention will be recognized and understood by those persons skilled in the art, one particular preferred embodiment of the fabric and methodology is described herein.

As explained more fully below, the fabric of the present invention is formed on a warp knitting machine which may be of various conventional types having multiple yarn guide bars and a needle bar, preferably a Raschel warp knitting machine having at least three yarn guide bars. The construction and operation of such machines are well-known in the knitting art and need not herein be specifically described and illustrated. In the following description, the yarn guide bars of the knitting machine are identified as "top", "middle", and "bottom" guide bars for reference purposes only and not by way of limitation. As those persons skilled in the art will understand, such terms equally identify knitting machines whose guide bars may be referred to as "front", "middle", and "back" guide bars, which machines of course are not to be excluded from the scope and substance of the present invention. As further used herein, the "bar construction" of a warp knitting machines refers to the number of yarn guide bars of the machine, while the "bar construction" of a warp knitted fabric refers to the number of different sets of warp yarns included in the fabric, all as is conventional terminology in the art.

As is conventional, the needle bar of the warp knitting machine carries a series of aligned knitting needles, while each guide bar of the machine carries a series of guide eyes, the needle and guide bars of the machine preferably having the same gauge, i.e., the same number of needles and guide eyes per inch. The preferred embodiment of the present warp knitted fabric is depicted diagrammatically in FIG. 2. The fabric is of a three-bar construction knitted on a three-bar warp knitting machine. According to this embodiment, the bottom guide bar of the machine is fully threaded on every guide eye with a set of elastic yarns 20 delivered from a warp beam (not shown), the middle yarn guide bar similarly is fully threaded on every yarn guide eye with a set of ground yarns 22 delivered from another warp beam (also not shown), and the top yarn guide bar is likewise fully threaded on every guide eye with a third set of yarns 24 delivered from a third warp beam (also not shown) suitable for achieving a satin-like surface effect in the knitted fabric, as hereinafter described.

The satin-effect yarns 24 preferably are multi-filaments synthetic yarns having a suitably bright and lustrous surface quality to achieve the desired satin-like surface appearance and feel in the completed fabric, e.g., a lustrous, bright multi-filament polyester yarn. The ground yarn predominantly imparts and controls the desired moldability of the overall fabric structure and, particularly, the fabric structure's important capability of retaining the molded three-dimensional configuration over extended use and laundering of the fabric. For such purpose, polyester yarns having a relatively high denier per filament preferably at least about 10 denier per filament with monofilament yarns most preferred, are utilized as the ground yarns and are selectively engineered through controlled draw warping to partially orient the polyester yarns (commonly referred to as POY) and impart to the yarns a substantially high degree of elongatability and a substantially high degree of shrinkability such that, when exposed to heat in a conventional fabric molding apparatus, the POY ground yarns will collapse by shrinkage into conformity with the mold and thereby further orient and heat set the yarns permanently into the molded shape. The elastic yarns 20 predominantly serve the function of contracting the knitted structure of the fabric, and particularly the knitted structure of the satin-effect yarns 24, in the relaxed state of the fabric so as to impart a more highly compacted stitch density (specifically the density of courses and wales per inch) in the fabric than would be achievable conventionally by the warp knitting of the ground and satin-effect yarns 22,24 alone. In this manner, the elastic yarns 20 serve to accentuate the satin-like surface appearance and effect created by the satin yarns 24 and to resist distension of the stitch structure of the satin-effect yarns during molding so as to maintain a substantially uniform satin-like effect in the fabric following the molding process.

By virtue of their high denier per filament, the collapsed heat-set ground yarns 22 collectively form a sufficiently stiff internal ground structure to the fabric, particularly in embodiments utilizing monofilament POY ground yarns, to optimally maintain the molded shape of the warp knitted fabric over extended usage. To achieve such results, the POY ground yarns should have an elongatability of at least about 55% elongation, preferably 60% elongation or greater, and a shrinkability between about 9% and 15% shrinkage, preferably in the range of approximately 10% to 12% shrinkage.

As will be understood, subject to the basic functions described above for the elastic, ground, and satin-effect yarns 20,22,24, those persons skilled in the art will recognize that the type, size, and physical characteristics of the yarns can be selectively varied as necessary or desirable to adjustably engineer the physical characteristics of the fabric, such as by way of example, the weight, hand, and dyeability of the fabric. In one preferred embodiment of the fabric, the satin-effect yarns are multi-filament 6—6 nylon yarns comprised of seven filaments making up a total denier of 20, although it is contemplated that other yarns having similar characteristics, such as 20 denier cationic dyeable multi-filament polyester could be substituted as the satin-effect yarns. The preferred ground yarn 22 is a 22 denier monofilament POY polyester yarn, although it is contemplated to be possible to vary the denier of the monofilament yarn or to use a comparable multi-filament yarn so long as the individual filaments have a sufficiently high denier per filament to provide the functionality described above, e.g., a 22 denier, two filament POY yarn. The preferred elastic yarn 20 is a 210 denier monofilament LYCRA® yarn manufactured by Du Pont de Nemours & Co. of Wilmington, Del., but other natural and synthetic rubber or spandex yarns can be substituted and elastic yarns of a lesser denier, e.g., a 140 denier elastic yarn, may be utilized to reduce the weight and expense of the fabric. Such variations will be apparent to persons of skill in the art and are intended to be within the scope and substance of the present invention.

Figure 2:
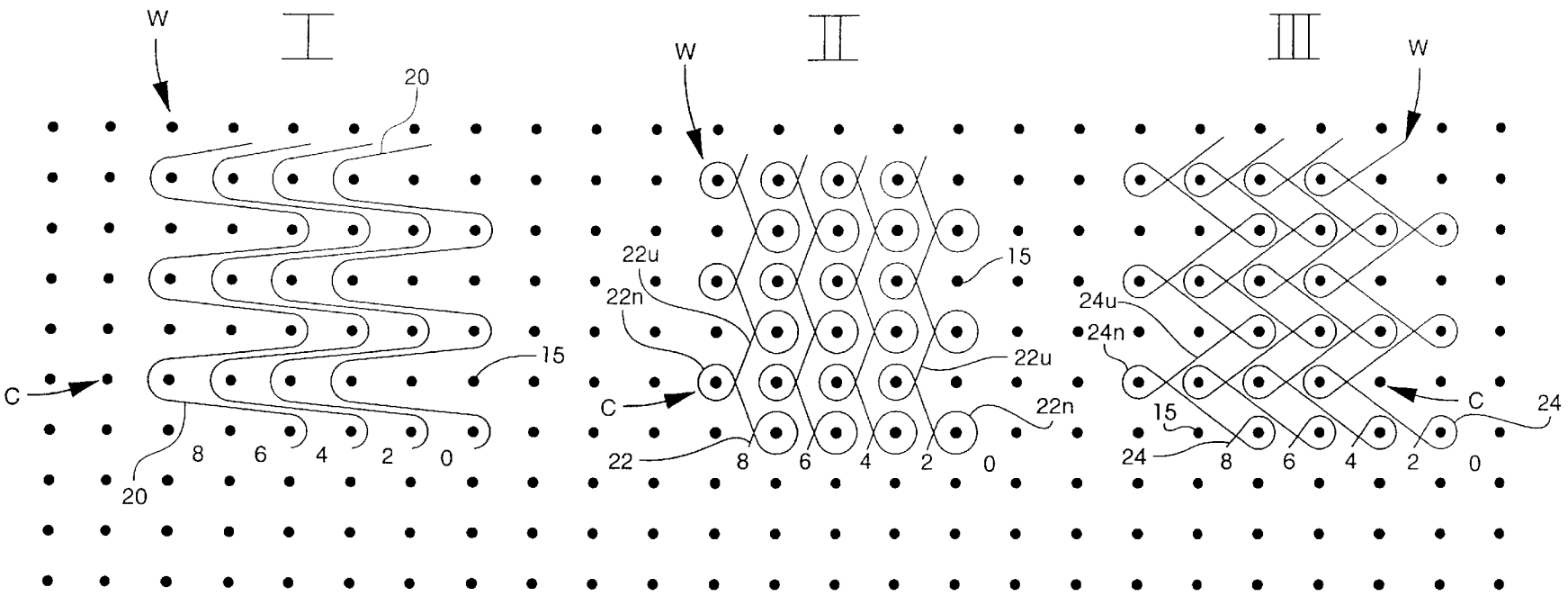
FIG. 2 is a diagram schematically depicting one preferred embodiment of the present warp knitted fabric, showing individually the stitch patterns for the three sets of warp yarns as carried out by a warp knitting machine in knitting the fabric.

In the diagram of FIG. 2, the particular preferred embodiment of the present warp knitted fabric is depicted in a traditional dot or point diagram format, wherein the stitch construction of the elastic, ground, and satin-effect yarns 20,22,24, as carried out by the respective lateral traversing movement of the guide bars of the knitting machine, are illustrated individually, the points or dots 15 in the diagram representing the needles of the needle bar of the knitting machine in the formation of several successive fabric courses C across several successive fabric wales W. According to this embodiment, the top (front) guide bar of the machine manipulates the satin-effect yarns 24 relative to the needles 15 of the needle bar of the machine to stitch the yarns 24 in a repeating 4-6, 2-0 stitch pattern as indicated at III of FIG. 2, as the yarns 24 are fed progressively from their respective warp beam. Simultaneously, the middle guide bar of the knitting machine manipulates the ground yarns 22 as they are fed from their respective warp beam to traverse relative to the needles 15 to stitch the ground yarns 22 in a repeating 2-0, 2-4 stitch pattern, as indicated at II of FIG. 2, while the bottom (back) guide bar of the knitting machine manipulates the elastic yarns 20 fed from their respective warp beam to traverse relative to the needles 15 to inlay the elastic yarns 20 in a repeating 0-0, 4-4 pattern, as indicated at I of FIG. 2.

As will thus be understood, the ground yarns 22 are interknitted with one another in the described stitch construction with each ground yarn 22 being formed in needle loops 22*n* alternating every other course C between a pair of adjacent vertical fabric wales W and in connecting underlaps 22*u* extending diagonally between the successive needle loops 22*n*. The satin-effect yarns 24 are interknitted with one another and with the ground yarns 22 with each satin-effect yarn 24 being formed in needle loops 24*n* alternating every course C between wales W spaced apart by one intervening wale W, the satin needle loops 24*n* being interknitted in plated relationship with the needle loops 22*n* of the ground yarn 22 in the respective wales W and underlaps 24*u* extending diagonally between the successive satin needle loops 24*n* in a substantially coursewise direction. The elastic yarns 20 are inlaid within the plaited needle loops 22*n*,24*n* of the ground and satin-effect yarns 22,24 to traverse back-and-forth coursewise across a span of three wales W.

In this manner, the ground yarns 22 form an essentially stabilized base or ground structure to the fabric substantially between the elastic and satin-effect yarns 20,24. The satin-effect yarns 24 appear outwardly of the ground yarns 22 at the technical back of the fabric, with the extended underlaps 24*u* of the satin-effect yarns 24 substantially obscuring the ground yarns 22 at the fabric's technical back to present a satin-like fabric surface. The inlaid elastic yarns 20 appear substantially at the technical face of the fabric and, as indicated above, serve to constrict the stitch construction of both the ground and satin-effect yarns 22,24 to compact their respective needle loops 22*n*,24*n* to further enhance the satin-like surface appearance of the yarns 24 at the technical back of the fabric.

As persons skilled in the art will recognize, the physical characteristics sought to be achieved in the ground yarns 22, specifically the relatively high degree of elongation of 55% to 60% or greater and the relatively high degree of shrinkability of 9% to 15%, are normally considered to be undesirable in conventional monofilament polyester yarns. Moreover, shrinkability within the desired range cannot be achieved by the conventional technique of manufacturing POY yarns by a draw twisting operation. In accordance with the methodology of the present invention, this generally undesirable and unique combination of characteristics is achieved by draw warping the polyester ground yarns under a controlled draw ratio at controlled temperature conditions to partially orient the ground yarns. Essentially, under the present method, the polyester ground yarns 22 are draw warped at a lesser draw ratio and, optionally, at lower temperature settings on the draw warping apparatus than would normally be utilized conventionally to produce POY yarns having elongation and shrinkage characteristics in the conventional ranges lower than those specified above under the present invention.

By way of example, but without limitation, POY ground yarns having the above-described physical characteristics contemplated under this invention have been produced by draw warping on a conventional draw warper manufactured by BARMAG Barmer Maschinenfabrik GmbH of Germany by utilizing a draw ratio of about 3.226:1 to draw base warp yarns from a spun denier of 73.5 to 22.5 denier at a warping speed of 600 meters per minute, without altering the conventional temperature settings of the machine, producing a drawn POY yarn of 22.5 denier with a 61% elongation at breakage under 95 grams of tensile force and a boiling water shrinkage of 10.7% (higher shrinkage could be obtained by reducing the heat set plate temperature of the draw warper). In contrast, conventional draw warping of base warp yarns of a spun denier of 82 under a conventionally higher draw ratio of 3.62:1 (or higher) at comparable temperature settings and warping speed, produces a warp of POY yarns having a 22.5 denier, 51.1% break elongation at 105.4 grams of tensile force, and a boiling water shrinkage of 5.5%, which would not perform acceptably under the present invention.

Of course, persons skilled in the art will readily recognize that, subject to the fundamental concept of utilizing a lower than conventional draw ratio and optionally lower draw warping temperatures in accordance with the method of the present invention, all of the parameters of the draw warping operation, e.g., warping speed, draw ratio, temperature, base feed yarn denier, etc. may be selectively varied as necessary or desirable to adjustably vary the finished denier, elongation, and shrinkage of the POY ground yarns for purposes of achieving corresponding variations in the resultant moldable fabric of this invention. Likewise, the draw warping operation performed under the present method may also be accomplished on other conventional draw warping machines, such as draw warpers manufactured by Karl Mayer Textilmaschinenfabrik GmbH, also of Germany. Such variations are accordingly intended to be within the scope and substance of the present invention.

Under the method of the present invention, following draw warping of the POY ground yarns 22, the thusly prepared warp of the ground yarns 22 along with warps of the elastic and satin-effect yarns 20,24 are warp knitted as aforedescribed into the fabric structure depicted in the diagram of FIG. 2, following which the warp knitted fabric is subjected to a heat-activated molding process, which may be conventional. Two basic types of molding apparatus are in common usage. Once such molding apparatus is equipped with mating heated male and female molding parts between which the fabric is captured to shape and heat set the fabric into the three-dimensional configuration of the mold. An alternative form of known molding apparatus employs a heated mold plug with a mated ring operative to hold the fabric about the base of the plug to maintain surface contact during the molding operation. It is contemplated that the fabric of the present invention may be suitably molded utilizing either conventional type of molding apparatus. In each case, the high elongatability of the present fabric facilitates penetration of the fabric by the male portion of the mold while the elastic yarns maintain the compact stitch structure of the fabric to minimize distension of the fabric structure and thereby maintain a substantially uniform satin-like surface appearance over the technical back of the fabric. With the fabric thusly engaged by the mold, the heat applied by the mold components, normally in a range between 395° F. and 400° F., induces the fabric to shrink sufficiently to collapse the fabric structure into intimate uniform surface conformity to the three-dimensional configuration of the mold. The fabric is maintained in the mold for a sufficient period of time to orient and heat set the ground yarns 22 permanently into the shape of the mold, after which the fabric is withdrawn from the mold, allowed to cool, trimmed as necessary about the perimeter of the molded shape, and then sewn with other fabric components in conventional manner to produce a brassiere garment such as depicted in FIG. 1.

As persons skilled in the art will recognize, the present invention fundamentally provides a fabric highly simulative of a traditional woven satin fabric having the capability not heretofore available in satin or satin-simulative fabrics of being heat-moldable using conventional molding technology. Accordingly, the present fabric provides enhanced aesthetic appearance, hand, and feel in comparison to known moldable fabrics, by which it is anticipated the present fabric will have substantially greater fashion appeal in the manufacture of brassieres having seamless breast cups, as well as other like garments in which seamless molded components may be desirable for reasons of appearance, fit, and/or comfort.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A warp knitted fabric characterized by a moldability to collapse and become set into a permanent shape conforming to a three-dimensional mold when subjected to heat essentially without distension of the knit structure of the fabric, said fabric comprising a set of yarns warp knitted in underlaps oriented sufficiently coursewise at the technical back of the fabric to provide a satin-simulative surface effect and a set of ground yams warp knitted in a stitch pattern forming a stabilized fabric ground structure, the ground yarns comprising POY polyester yarns having a substantially high denier per filament of at least about 10 denier per filament, a substantially high degree of elongatability of at least about 55% elongation, and a substantially high degree of shrinkability of at least about 9% shrinkage to impart a collapsibility and setability to the knitted structure of the ground yams in the presence of heat.

2. A warp knitted fabric according to claim 1, wherein the ground yarns are monofilaments.

3. A warp knitted fabric according to claim 1, wherein the ground yarns have an elongatability of at least about 60% elongation.

4. A warp knitted fabric according to claim 1, wherein the ground yarns have a shrinkability of at least about 10% shrinkage.

5. A warp knitted fabric according to claim 1, further comprising a set of elastic yarns warp knitted at the technical face of the fabric.

6. A warp knitted fabric according to claim 5, wherein the elastic yarns comprise at least about 10% to 15% of the fabric by weight.

7. A warp knitted fabric according to claim 1 wherein the satin-effect yarns are warp knitted in a 4-6, 2-0 stitch pattern and the ground yarns are warp knitted in a 2-0, 2-4 stitch pattern.

8. A warp knitted fabric according to claim 7, further comprising a set of elastic yarns warp knitted in a 0-0, 4-4 inlaid pattern.

9. A seamless molded breast cup for a woman's brassiere formed of the warp knitted fabric of claim 1.

10. A warp knitted fabric of a three-bar construction characterized by a moldability to collapse and become set into a permanent shape conforming to a three-dimensional mold when subjected to heat essentially without distension of the knit structure of the fabric, said fabric comprising a set of yams warp knitted in a 4-6, 2-0 stitch pattern forming underlaps oriented sufficiently coursewise at the technical back of the fabric to provide a satin-simulative surface effect, a set of elastic yarns warp knitted in a 0-0, 4-4 inlaid pattern, and a set of ground yams warp knitted in a 2-0, 2-4 stitch pattern forming a stabilized fabric ground structure, the ground yarns comprising monofilament POY draw-warped polyester yarns having a substantially high degree of elongatability of at least about 60% elongation and a substantially high degree of shrinkability of at least about 10% shrinkage to impart a collapsibility and setability to the knitted structure of the ground yarns in the presence of heat, the elastic yarns constricting the fabric when relaxed to impart a compacted stitch density to the fabric to enhance the coursewise orientation and the satin-like surface effect of the satin-effect yarns.

11. A warp knitted fabric according to claim 10, wherein the satin-effect yarns are multifilament yarns of approximately 20 denier and the ground yarns are monofilament yarns of approximately 22 denier.

12. A seamless molded breast cup for a woman's brassiere formed of the warp knitted fabric of claim 10.

13. A method of forming seamless molded fabric portion, comprising:

a) draw warping a set of high denier-per-filament polyester yarns at a selected draw ratio and selected temperature conditions to partially orient the yarns while imparting a substantially high elongatability of the yarns of at least about 55% elongation and a substantially high shrinkability of the yarns of at least about 9% shrinkage, b) warp knitted a textile fabric comprising a set of yams warp knitted in underlaps oriented sufficiently coursewise at the technical back of the fabric to provide a satin-simulative surface effect and the set of draw-warped partially-oriented polyester yarns warp knitted in a stitch pattern forming a stabilized fabric ground structure, and c) placing the warp knitted fabric over a molding surface and subjecting the fabric to sufficient heat to shrink and set the partially-oriented polyester ground yarns causing the fabric to collapse into a permanent shape conforming to the molding surface.

14. A method of forming a seamless molded fabric portion according to claim 13, wherein said draw warping imparts an elongatability to the polyester yarns of at least about 60% and a shrinkability to the polyester yarns of at least about 10%.

15. The method of forming a seamless molded fabric portion according to claim 13, wherein the polyester yarns comprise monofilament polyester yarns.

16. The method of forming a seamless molded fabric portion according to claim 13, wherein said warp knitting comprises inlaying an elastic yarn with the satin-effect and ground yarns at the technical back of the fabric.

17. The method of forming a seamless molded fabric portion according to claim 13, wherein said warp knitting comprises warp knitting the satin effect yarns in a 4-6, 2-0 stitch pattern and warp knitting the polyester ground yarns in a 2-0, 2-4 stitch pattern.

18. The method of forming a seamless molded fabric portion according to claim 13, and further comprising providing a breast cup mold as the molding surface for forming the fabric into a seamless molded breast cup for a woman's brassiere.

* * * * *